US005349802A

United States Patent [19]

Kariniemi

[11] Patent Number: 5,349,802

[45] Date of Patent: Sep. 27, 1994

[54] POSITIONER/FASTENER

[76] Inventor: Stephen D. Kariniemi, 500 13th St. S., Buffalo, Minn. 55313

[21] Appl. No.: 998,750

[22] Filed: Dec. 29, 1992

[51] Int. Cl.[5] ..... E04B 1/38; E04C 1/14

[52] U.S. Cl. ..... 52/543; 52/520; 52/551; 52/478; 52/536

[58] Field of Search ..... 52/531, 543, 551, 520, 52/522, 536, 478, 506, 508, 403, 401, 488, 489, 396, 384, 385, 391

[56] References Cited

U.S. PATENT DOCUMENTS

| | | | |
|---|---|---|---|
| 2,066,205 | 12/1936 | Keating | 52/506 |
| 2,135,118 | 11/1938 | Stewart | 52/384 |
| 2,187,752 | 1/1940 | Olsen | 52/488 |
| 3,131,513 | 5/1964 | Grigas et al. | 52/520 |
| 3,188,774 | 6/1965 | McCorkle | 52/520 |
| 3,364,641 | 1/1968 | Brenneman | 52/401 |
| 3,508,369 | 4/1970 | Tennison | 52/403 |
| 4,969,302 | 11/1990 | Coggan et al. . | |

OTHER PUBLICATIONS

Generic installation manual.

Western Wood Products book published yearly.

Masonite Siding Products manual published Apr. 1987.

*Primary Examiner*—James L. Ridgill, Jr.

*Attorney, Agent, or Firm*—Merchant, Gould, Smith, Edell, Welter & Schmidt

[57] ABSTRACT

A siding positioner/fastener that consists of a strip 40 with a continuous length, with inserts 50 coupled to it, at spaced intervals along the length of the strip. The strips are positioned and coupled to a substrate, aligning the strips perpendicular to the channel 70 length, which is parallel to the siding length, with a strip at each interval along the siding length, and with the inserts inline and parallel across each strip interval. A sloped channel is coupled to the back of the siding length. At each end the channel can slide on, or be pressed onto the inserts. The remaining inserts are pressed on. Each time an insert is locked onto the channel this aligns the following insert. When all the inserts are locked onto the channel, the siding can be moved parallel to the its length, or expand and contract its width. The insert length will allow two pieces of siding to be butted against each other on one insert.

20 Claims, 4 Drawing Sheets

POSITIONER/FASTENER

BACKGROUND OF INVENTION

1. Field of Invention

The subject Invention generally pertains to positioning and fastening materials, and more specifically at its relates to siding.

2. Description of Related Art

Siding Fasteners

Siding may be positioned horizontal, vertical or at an angle. It may have a variety of heights and lengths. The length will be referred to as parallel and the height as perpendicular for further orientation.

Parallel to the siding length are two edges, one edge is referred to as the tip and the other edge is the butt. There are two sides. One is the face (exposed) side which is visible, and the other is the back(unexposed) side which looks at the substrate. The substrate is what the siding covers.

Siding generally overlaps the preceding siding row. The siding butt lays over the preceding siding tip. That leaves some of the face side exposed to view. This portion is referred to as the exposure height or exposure.

Siding is made out of a variety of products like, wood, wood or fiber compositions (sometimes called hardboard), aluminum, steel, vynil, and others.

These sidings are fastened a variety of ways. It may be nailed, stapled, or screwed. Some is fastened by interlocking a butt to a tip and then fasten the tip to the substrate also. Others fasten by interlocking the butt to the preceding siding tip and then nail thru a slot in the tip to hand the siding. Some have a spline that hooks the preceding tip and then fasten the tip to the substrate again. Some are nailed thru the butt with the butt overlapping the preceding tip, thereby the nail holds the tip down also.

Some of these sidings are positioned by snapping chalklines for each row and then aligning the siding to the lines. Others rely on a consistent heigth of the siding and key off that.

Some of the problems with the current ways siding is positioned and fastened that this positioner/fastener eliminates.

1. Establishing the siding exposure when it is being installed.
2. Marking points and snapping chalklines or stringing lines to serve as a guide for each row of siding.
3. Maintaining the exposure over the length of the row and keeping the siding parallel, and consistently from row to row.
4. Utilizing the siding height to determine the next row.
5. Aligning a nail properly, for attaching to the substrate and the stud line, of each row of siding.
6. Using special starter strips to start the first row of siding on.
7. Stack or hook the siding the tip of the preceding row of siding.
8. Drilling holes or putting slots in the siding for nailing thru.
9. Aligning a nail in the right slots and positioned it properly in the slots of the siding and maintaining the right perpendicular relationship of the nail shaft to the siding face.
10. Aligning a nail at the proper height at each row.
11. Driving a nail thru the siding and brining the nail head to the right depth relative to the siding face.

12. There may be a knot in the siding right where it should be nailed.
13. The fastener may become to loose or to tight from the siding expanding or contracting
14. The siding may become to loose or to tight from the siding expanding or contracting.
15. The installer may not know if the siding is at its high, average or low expansion point when installing.
16. The fastener may be exposed to view on the siding or it may break the coating film and leave a blemish or allow moisture in.
17. The sliding may not have sufficient structural strength to prevent a nail from tearing thru it.

This invention is a positioner and a fastener that serves many functions and can operate independently of the siding composition, size and coating finish and can also be incorporated into manufactured siding. It gives full parallel and horizontal expansion and contraction. It improves the quality of installing siding, it installs faster, yet requires less training.

SUMMARY OF THIS POSITIONER/FASTENER

To avoid the limitations and problems with the present methods of positioning and fastening siding, the objects of this Positioner/Fastener are:

Eliminates establishing the siding exposure, by the inserts being preset at the proper intervals.

Eliminates establishing the siding rows, positioning the following rows of siding with the top of the rabbit against the top of the tip of the preceding row of siding, the siding positioning restricting the expansion of the siding, siding exposure variations from one siding row to another, by the strip with the inserts at intervals.

Eliminates establishing parallel lines for a starter strip or the siding rows, by the strip length being aligned perpendicular to the siding length, at intervals along the siding length, with the insert aligned parallel at each siding length interval.

Eliminates positioning a starter strip on a parallel line at each fastening column, by the aligned strips and inserts make a starting line.

Eliminates aligning each siding row at each fastening column, by the inserts when locked into the channel step aligns the next insert.

Eliminates siding exposure variations along the length of the siding, by the channel interlocked to the inserts that are aligned parallel across each fastening column.

Eliminates interlocking a siding continuous butt interlock (or spline) into a continuous starter strip interlock or the preceding siding row continuous tip interlock (or tip), the length of the siding, because the channel interlocks onto parallel inserts at the fastening columns.

Eliminates positioning the siding continuous tip interlock against a substrate, by when the channel is interlocked onto an insert it positions the siding tip against the substrate.

Eliminates drilling holes or slots in siding, or a nail head restricting expansion, or being exposed to view, or blemishing the face, because the channel is attached to the back of the siding.

Eliminates establishing the parallel lines, for the nailing and positioning a nail on the siding face, because the channel is preset parallel on the siding.

Eliminates positioning a nail in a nailing slot, or driving the nail head close to the face, or the nail head or shaft restricting expansion, by the continuous channel locks onto the insert.

Eliminates driving a nail thru a siding butt, a tip, or both, and also close to the siding face, and a fastener loosening from expansion of the siding or splitting when being nailed, or the siding loosening from contraction of the siding, because the channel locks onto the insert head.

Eliminates a fastener breaking the coating film of the siding because the channel can be attached prior to the coating film being applied.

These and other objects of the invention are provided by a novel siding positioner/fastener that consists of a strip with inserts coupled to it. The strips are coupled to a substrate, aligning the strips perpendicular to the channel length, and at intervals along the channel length, with the inserts inline and parallel across each strip interval. A sloped channel is coupled lengthwise to the back of the siding that locks onto the inserts. The siding can move parallel to its length or expand and contract its width.

DESCRIPTION OF THE PREFERRED EMBODIMENT

Components of the Positioner/Fastener

Figure 1:
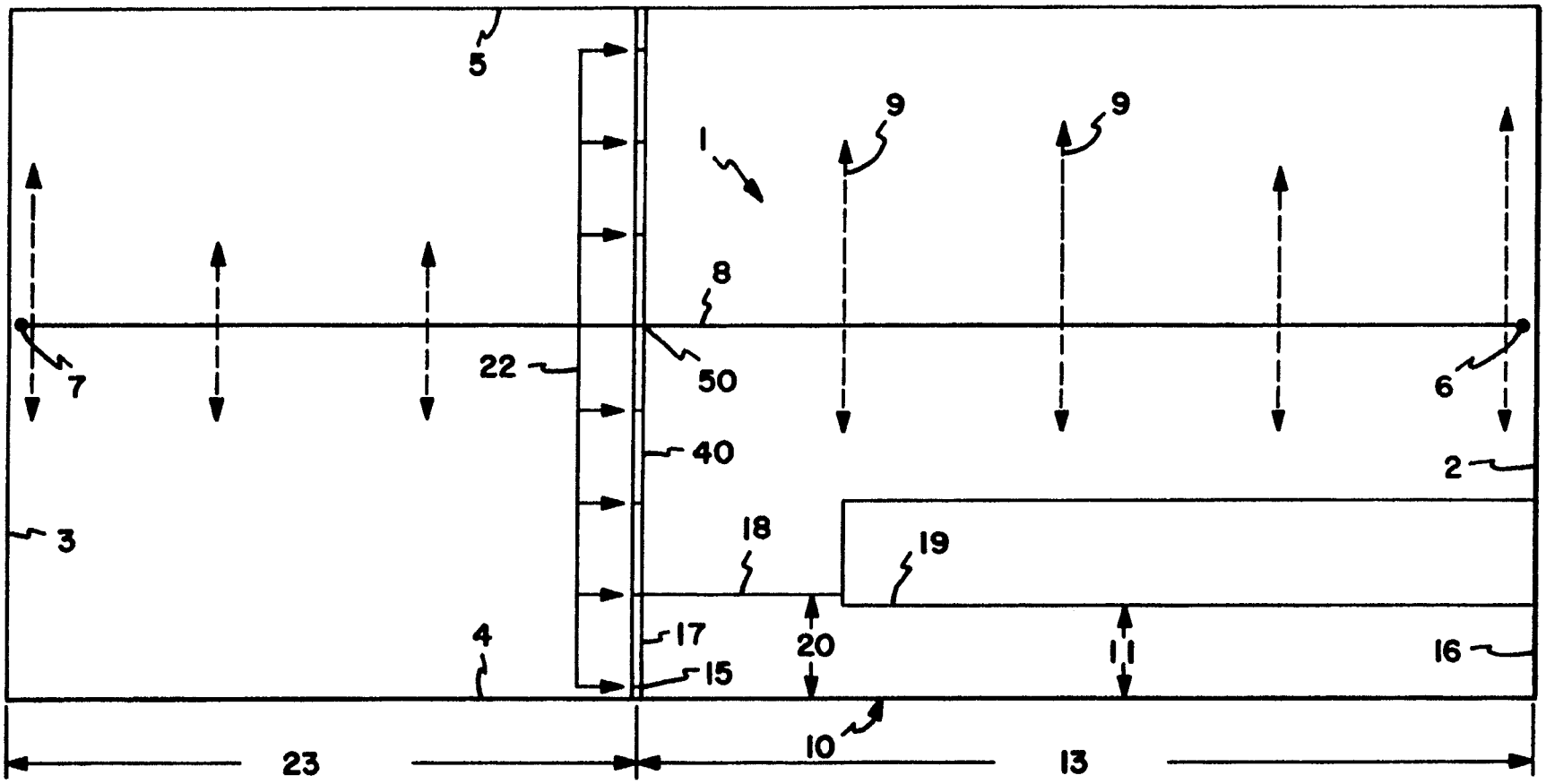
FIG. 1 illustrates an elevation view of a partially sided substrate.

A strip which attaches to a substrate.

A channel which attaches to or is a part of the the siding.

Reserved numbers #1–39 for peripheral items.

Reserved numbers #40–69 for strip components.

Reserved numbers #70–99 for channel components.

Refer to FIG. #2. Preferably, although not necessarily, the positioner/fastener is of a molded polymer. A strip 40, a insert 50, and a channel 70 are the three profiles that make up the positioner/fastener in an extruded mode. These profiles need to be formed consistently within the functionality tolerances. This may vary relative to the polmer used, sizing, environment, siding, and other factors. The strip 40 profile is a width 42 and a height 43 with a continuous length 41. The widths 42 and the lengths 41 encompass the face 44 and the back. The heights 43 and the lengths 41 encompass the right-side 45 and the left-side 46. The insert 50 profile is a width 52 and a height 53 with a continuous length 51. The widths 52 and lengths 51 encompass a base 54 and a contoured shape. The lengths 51 are a bottom-edge 55 and a top-edge 56. The contoured shape consists of a right-shoulder 57 that slopes away from the base 54 to a neck 58, and a left-shoulder 59 that slopes away from the base 54 to the neck 58. The neck 58 connects a head 60 to the shoulders 57&59. The head 60 has a right-lobe 61 and a left-lobe 62 that makes the head 60 wider than the neck 57. The insert 50 is coupled to the face 44 of the strip 40, at intervals 63, with the insert 50 length 51 then shortened to the strip 40 width 42, and located perpendicular to the strip 40 length 41. The channel 70 consists of a continuous length 71, with a U-shaped profile. At the curve is a centerwall 72, with a leftwall 73 and a rightwall 74. At the leftwall 73 is a left-retainer 75, and a left-slope 80, and at the rightwall 74 is a right-retainer 76, and a right-slope 81. Both slopes 80&81 angle towards each other to an opening 77. Encompassed by the opening 77, retainers 75&76, and walls 72&73&74 is a cavity 78. On the rightwall 74 and leftwall 73, opposite the cavity 78, may be compression flanges 79.

OPERATIONS OF THE POSITIONER/FASTENER

Figure 2:
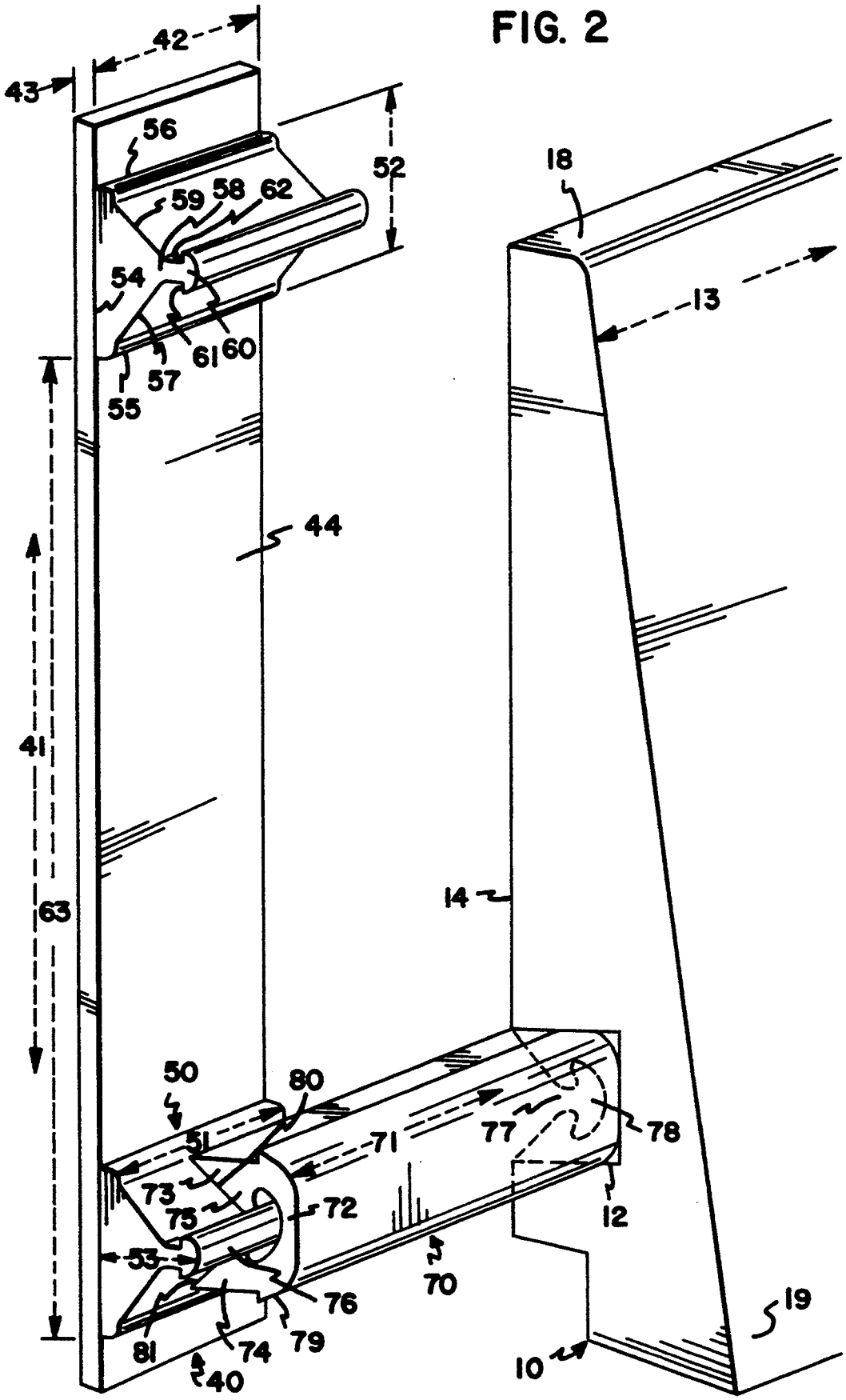
FIG. 2 illustrates a three demensional view of the first embodiment of the positioner/fastener and siding.
Figure 3B:
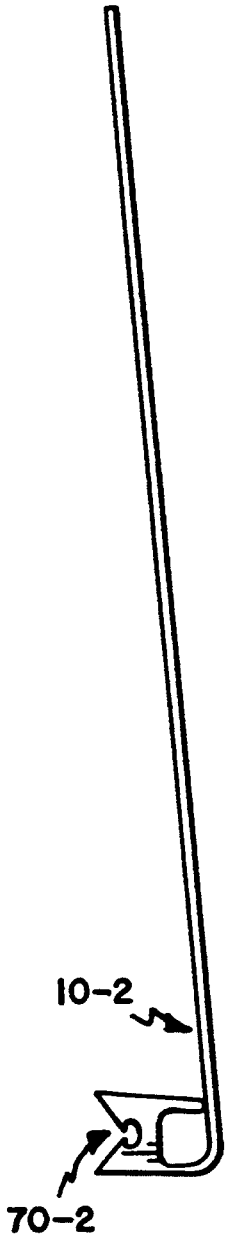
FIGS. 3A–E illustrate in side view the first embodiment of the positioner/fastener and siding, and second, third, fourth, and fifth embodiments.
Figure 3C:
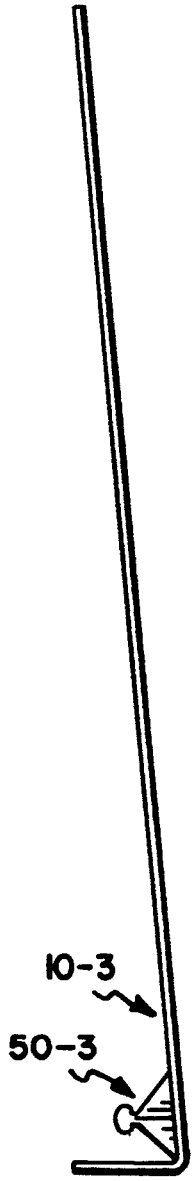
Figure 3A:
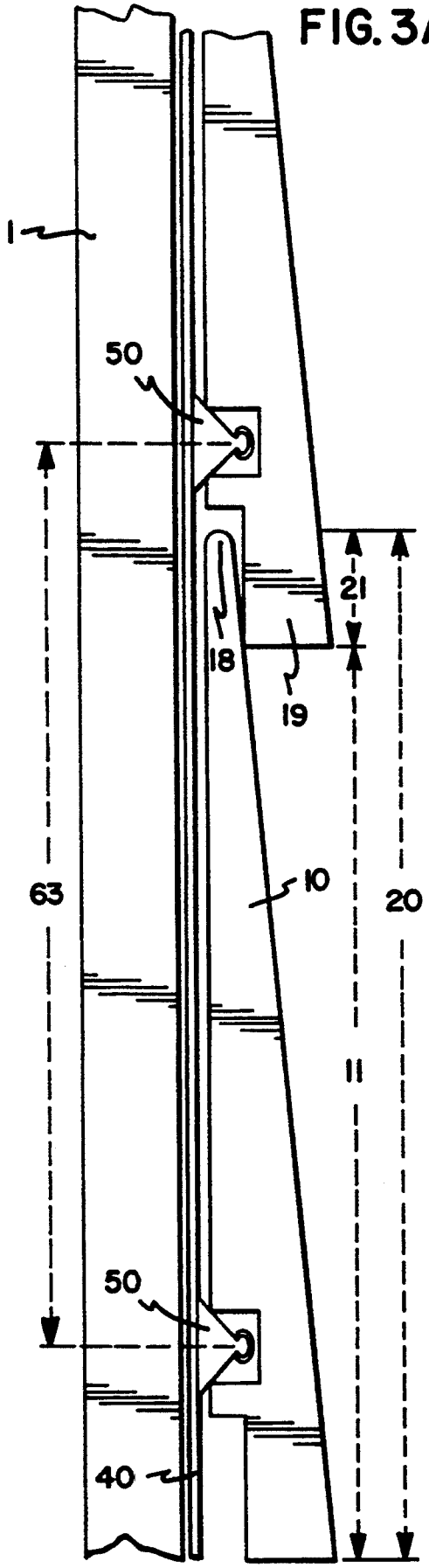
Figure 3D:
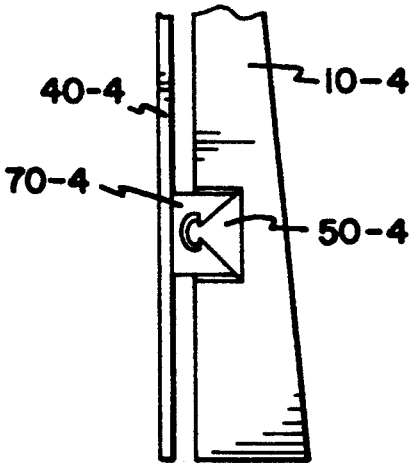
Figure 3E:
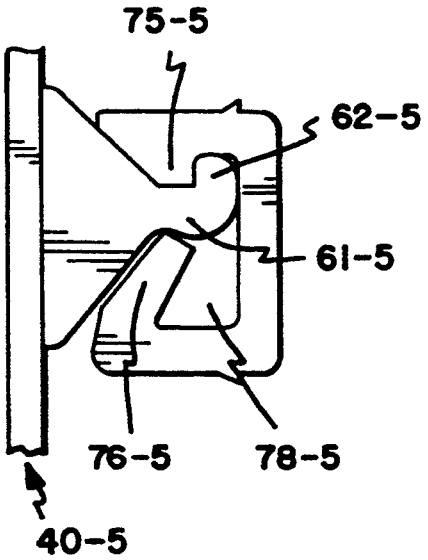

Refer to FIG. 1. An elevation view of a substrate 1, a start-edge 2, a stop-edge 3, a baseline 4, a topline 5, the start-mark 6, the stop-mark 7, a straightline 8, strip-intervals 9, siding 10, an exposure 11, a notch 12, siding 10 length 13, a start-end 16, an stop-end 17, parallel lines 22, a strip 40. Refer to FIGS. 3A. The siding 10 tip 18, butt 19, siding 10 height 20, overlap 21. Refer to FIG. 2. Cut a notch 12 into the siding 10, parallel to the length 13, on the back 14, from one end to the other end. Couple the channel 70 in the notch 12. Refer to FIG 3B. A second embodiment makes the channel 70-2 a part of the siding 10-2. Refer to FIG. 3C. A third embodiment makes the insert 50-3 a part of the siding 10-3. Refer to FIG. 3D. A fourth embodiment is to couple the insert 50-4 to the siding 10-4 and the channel 70-4 to the strip 40-4. Refer to FIG. 3E. A fifth embodiment changes the right-retainer to a flap 76-5, enlarges the left-retainer 75-5, enlarges the cavity 78-5, enlarges the left-lobe 62-5, changes the right lobe to a flap 61-5. Refer to FIG. 3A. The siding 10 width 20 less the overlap 21 is the exposure 11 which is also the insert 50 interval 63 of the strip 40. Refer to FIG. 1. On the substrate 1 to be covered with siding 10 establish a start-mark 6 and a stop-mark 7, and connect with a straight-line 8. Mark the strip-intervals 9 along the straight-line 8. Align and fasten the strips 40 at the strip-intervals 9, with the insert 50, on the straight-line 8, and perpendicular to the straight-line 8, thereby making parallel rows 22 of inserts 50 from the base-line 4 to the top-line 5. Measure along the base-line 4 from the start-edge 2 to the center of the example-inert 15. Cut a piece of siding 10 to this length 13. At the stop-end 17 of the siding 10, and the example-insert 15, refer to FIG. 2, slide the channel 70 far enough onto the insert 50 to lock the channel 70, refer to FIG. 1, to the example-insert 15, and to reverse direction, and slide the siding 10 at the start-end 16 onto the insert, on the strip-interval 9, next to the start-edge 2, until the siding 10 start-end 16 butts the start-edge 2. The siding 10 step-end 17 will be halfway on the example-insert 15. At the next strip-interval 9 towards the start-edge 2, on the same parallel line 22, refer to FIG. 2, the channel 70 slopes 80&81 will guide the insert 50 head 60 to the opening 77, refer to FIG. 1, as the siding 10 is being pressed towards the substrate 1. At the same time this action will be aligning the next insert the next strip-interval 9 towards the start-edge 2. Refer to FIG. 2. Continue pressing causing the head 60 to enlarge the opening 77 until the head 60 is in the cavity 78. Then the head 60 releases the retainers 75&76 which spring back towards their original location, and now also at the neck 58 of the insert 50 thereby locking the head 60. Refer to FIG. 1. Repeat at the remaining strip-intervals 9. Measure from the stop-end 17 to the center of another insert or to the stop-edge 3. Cut a piece of siding 10 to this length 23, refer to FIG. 2, slide the channel 70 onto the half covered insert 50, refer to FIG. 1, until the siding butts the previous siding 10 stop-end 17. At the other end of the siding align the channel with the insert and press it on to lock. At the remaining strip-intervals 9 press to lock. Repeat at the remaining parallel rows 22 to the top-line 5.

Although the invention is described with respect to a preferred embodiment, modifications thereto will be apparent to those skilled in the art. Therefore the scope of the Positioner/Fastener is determined by reference to the claims which follow:

I claim:

1. A fastener system for attaching siding to a substrate comprising:

a longitudinal strip mounted to the substrate;

a plurality of overlapping siding members extending parallel to one another and transverse to the strip;

a plurality of channels and inserts mounting the siding members to the strip, one of the plurality of channels or plurality of inserts affixed to the strip in a spaced apart configuration, and the other of the plurality of channels and plurality of inserts affixed to the siding members one per siding member;

the inserts each including an enlarged head;

the channels each defining a U-shaped profile with each channel including first and second retainers defining a narrowed opening and an enlarged cavity interconnected therewith, the cavity of each channel receiving the enlarged head of one of the inserts, and the first and second retainers retaining the enlarged head in the cavity;

wherein each siding member is mounted to the strip with only one hold down location defined by the channels and the inserts for each siding member.

2. The fastener of claim 1, wherein the channels and the inserts all extend in a longitudinal direction transverse to the strip, wherein the channels and the inserts are made of a polymeric material, and wherein the channels and the inserts have a continuous cross-section.

3. The fastener system of claim 1, wherein the inserts are affixed to the strip.

4. The fastener system of claim 3, wherein the channels are part of the siding members.

5. The fastener system of claim 1, wherein the channels are affixed to the strip.

6. The fastener system of claim 5, wherein the inserts are part of the sliding members.

7. The fastener system of claim 1, wherein each of the siding members comprises wood, and each of the siding members includes a portion defining a notch formed therein, wherein the channels are made of a polymeric material and each channel is disposed in the notch of one of the siding members.

8. The fastener system of claim 7, wherein each channel includes oppositely disposed sidewalls spaced apart to define the cavity for receipt of the enlarged head of the insert, the retainers each projecting from one of the sidewalls of the channel, the retainers being bendable toward the respective one sidewall the retainers project from during insertion of the enlarged head of insert into the cavity, and the sidewalls being constrained from movement away from the insert by the portion of the siding member defining the notch.

9. The fastener system of claim 7, wherein each channel includes an external flange engageable with the portion of the siding member defining the notch.

10. The fastener system of claim 9, wherein each channel includes two oppositely disposed external flanges engageable with the portion of the siding member defining the notch.

11. The fastener system of claim 1, wherein the channels are made of resilient material.

12. The fastener system of claim 11, wherein the channels extend longitudinally and each define a continuous symmetrical cross-section, and wherein the inserts extend longitudinally and each define a continuous symmetrical cross-section.

13. The fastener system of claim 11, wherein the channels extend longitudinally and each define a continuous nonsymmetrical cross-section, and wherein the inserts extend longitudinally and each define a continuous nonsymmetrical cross-section.

14. The fastener system of claim 13, wherein the inserts each includes two retainer surfaces disposed on opposite sides of the enlarged head, one retainer surface of the insert being enlarged relative to the other, wherein the first retainer of the channel extends further than the second retainer to define a flexible flap, and wherein the channels each define a cavity for receipt of the flexible flap during insertion of the insert, the enlarged retainer surface of the insert being positioned away from the flexible flap of the channel.

15. The fastener system of claim 11, wherein the channels each include two guide surfaces for guiding the enlarged head of the insert into the channel, the guide surfaces sloped at an angle relative to the direction of insertion, the guide surfaces extending in a direction of the strips longer than the enlarged head of the insert.

16. The fastener system of claim 15, wherein the insert includes two shoulders each disposed at an angle relative to the direction of insertion, each shoulder being reciprocally shaped to one of the guide surfaces.

17. The fastener system of claim 11, wherein the channels each include two second internal cavities and the retainers of the channel flex away from the enlarged head of the insert and into the second cavities as the enlarged head of the insert is inserted into the channel member.

18. The fastener system of claim 17, wherein each siding member includes a portion defining a notch, wherein the inserts are mounted to the strips, and wherein each channel is mounted to one of the siding members, wherein the channel is positioned in the notch of the siding member.

19. The fastener system of claim 17, wherein each siding member includes a portion defining a notch, wherein the channel are mounted to the strips, and wherein each insert is mounted to one of the siding members, wherein the insert is positioned in the notch of the siding member, and wherein the channels are positioned at least partially in each notch of the siding member.

20. A fastener system for attaching siding to a substrate comprising:

a plurality of inserts, each insert including a head and two retainer surfaces;

means for mounting the inserts in a spaced apart configuration to the substrate;

a plurality of overlapping siding members, each siding member including a notch formed therein with two oppositely disposed sides, each siding member positioned adjacent to at least one insert; and a channel member comprised of a polymeric material positioned in the notch of each siding member, the channel member including a base and two oppositely disposed sidewalls extending from the base to define a cavity, the sidewalls each including a flexible retaining lip projecting inwardly toward the base, the retaining lip of each sidewall of each channel member being bendable toward the respective sidewall during insertion of the head of the insert into the cavity, the sidewalls of each channel member being constrained from movement away from the head of the insert by the sides of the notch of the siding member, each retainer surface of the head of the insert engaged with one of the retaining lips of the channel member to attach the siding members to the substrate.

* * * * *